US011585628B2

(12) United States Patent
Potter

(10) Patent No.: US 11,585,628 B2
(45) Date of Patent: Feb. 21, 2023

(54) FLETCHING JIG AND RELATED METHOD OF USE

(71) Applicant: Bohning Company, Ltd., Lake City, MI (US)

(72) Inventor: Robert L. Potter, McBain, MI (US)

(73) Assignee: Bohning Company, Ltd., Lake City, MI (US)

( * ) Notice: Subject to any disclaimer, the term of this patent is extended or adjusted under 35 U.S.C. 154(b) by 40 days.

(21) Appl. No.: 17/238,801

(22) Filed: Apr. 23, 2021

(65) Prior Publication Data

US 2022/0341700 A1 Oct. 27, 2022

(51) Int. Cl.
*F41B 5/00* (2006.01)
*F41B 5/14* (2006.01)

(52) U.S. Cl.
CPC ..... *F41B 5/1446* (2013.01)

(58) Field of Classification Search
CPC ..... F41B 5/1446
See application file for complete search history.

(56) References Cited

U.S. PATENT DOCUMENTS 4,653,738 A * 3/1987 York ..... B25B 1/20 269/38
4,867,426 A * 9/1989 Mellick ..... F41B 5/1446 269/38
4,919,405 A * 4/1990 York ..... F41B 5/1446 269/38
5,207,129 A * 5/1993 Fossella ..... B25B 21/004 81/58.4
6,073,522 A * 6/2000 Carnesi ..... B25B 13/44 81/128
10,451,393 B2 10/2019 Potter
2006/0157942 A1* 7/2006 Ferrari ..... B60C 25/138 279/114
2016/0377393 A1* 12/2016 Potter ..... F42B 33/001 156/578

FOREIGN PATENT DOCUMENTS

CN 207180498 * 4/2018 ..... F41B 5/1446

* cited by examiner

*Primary Examiner* — John E Simms, Jr.
(74) *Attorney, Agent, or Firm* — Warner Norcross + Judd LLP

(57) ABSTRACT

A fletching jig can include constrictor ring that, when rotated, urges a plurality of arms supporting respective vanes toward an arrow supported in the jig to fletch the arrow. The arms can extend away from a base, which can support the arrow along a central axis. The actuator ring can be disposed around the arms. The actuator ring can include a ramp that can engage multiple guide blocks adjacent the actuator ring, each guide block configured to push a respective arm toward the arrow as the ring rotates. A related method of use is provided.

19 Claims, 6 Drawing Sheets

FLETCHING JIG AND RELATED METHOD OF USE

BACKGROUND OF THE INVENTION

The present invention relates to archery products, and more particularly to a fletching jig used to fletch archery arrows or bolts.

Arrow fletchings or vanes, referred to interchangeably herein as vanes, stabilize an arrow in flight by providing drag at the tail end of the arrow. The fabrication and repair of archery arrows or bolts, referred to interchangeably herein as arrows, requires attachment of vanes to the shaft of the arrow. Typically, two, three or four vanes are adhered to the shaft with an adhesive at even angular displacements around the circumference of the shaft. The vanes can be disposed parallel to the axis of the shaft, or can helically spiral around part of the shaft. Skill and patience are required to prepare the shaft and to apply the proper amount of adhesive to achieve a durable bond between the vane and the arrow. The vanes also must be held in place for a period of several minutes to several hours as the adhesive cures, so that the vanes do not move before the adhesive has cured, which would cause imperfect placement and/or alignment of the vanes along the arrow, which in turn can be detrimental to the stabilization and flight of the arrow.

During the course of shooting the arrows, whether in a tournament or during practice for competition or hunting, it is not uncommon to damage vanes, especially when shooting at a single spot on a target. When the vanes are damaged, an archer will typically repair them to ensure that the associated arrow files true again. This means that an active archer may find themselves repairing vanes with high frequency, which can be tedious and time consuming.

For the purpose of adhering vanes to arrows, for example, to install anew or repair vanes, there is a variety of fletching jigs that hold vanes against the shaft of the arrow in a predetermined orientation. Most fletching jigs, however, are either specifically set for particular numbers of vanes, particular types of vane positioning and/or shaft diameters, or the adjustments required are unwieldy and time-consuming when servicing or building a variety of arrows having different vane patterns or shaft diameters.

Accordingly, there remains room for improvement in the field of fletching jigs that can easily or automatically adapt to various vane patterns and arrow shaft diameters.

SUMMARY OF THE INVENTION

A fletching jig is provided including a constrictor ring having an actuator ring that, when rotated, urges a plurality of arms supporting respective vanes toward an arrow supported in the jig to fletch the arrow.

In one embodiment, the multiple arms that support the respective vanes can be movably or pivotally joined with the base. The arms can extend away from a base, which can support the arrow along a central axis.

In another embodiment, the constrictor ring can be disposed around the arms. The constrictor ring can be configured to contact and engage the arms as the arms support respective vanes in engagement with the arrow.

In still another embodiment, the constrictor ring can include a support portion that remains stationary relative to the arms while holding them in a position adjacent the arrow. The actuator ring can be disposed adjacent the support portion, and rotatable relative to that support portion.

In yet another embodiment, the support portion can include one or more guides that interface with corresponding guide blocks, which are moveably disposed and aligned with respective ones of the arms.

In even another embodiment, the actuator ring can be rotatably mounted on the support portion. The actuator ring can include a ramp that interfaces with the guide blocks supported by the support portion to move those blocks in a linear manner toward the arms to thereby urge the arms toward the central axis, when the actuator ring is rotated about the central axis, such that the vanes on the respective arms adequately engage the arrow.

In a further embodiment, the ramp can include a first ramp part configured to engage a first guide block of the plurality of guide blocks, and a second ramp part configured to engage a second guide block of the plurality of guide blocks. The ramp parts can be separate and independent from one another, and can follow different curved paths. The ramp parts can each curve radially inward toward the central axis, but at locations about the central axis distal and separate from one another.

In still a further embodiment, each of the guide blocks can include a projection. The first ramp part can slidably engage a first projection when the actuator ring rotates, and the second ramp part can slidably engage a second projection when the actuator ring rotates.

In yet a further embodiment, the ramp is configured so that the rotational translation of the actuator ring engages the arms to move those arms radially inward, toward the arrow and the central axis. As the arms move radially inward toward the axis, they also can pivot at a lower end thereof about an axis of a linkage or pin that secures the respective arms to the base. Thus, as the actuator pin rotates, the arms also can pivot and can move radially and/or linearly inward toward the arrow.

In even a further embodiment, the support portion can include guide channels within which the guide blocks are slidably disposed at predetermined angles about the central axis. The guide channels can be oriented with their respective axes pointed toward the central axis, and the movement of the guides in those guide channels can be limited to a linear motion, toward the axis.

In a further embodiment, a method of fletching an arrow is provided. The method can include: providing arms pivotally joined with a base, each arm supporting a respective vane; placing an arrow along a central axis of the base; moving the arms toward the central axis and the arrow; and rotating an actuator ring around the central axis to urge arms toward the central axis, whereby the respective vanes supported on the respective arms are moved toward the arrow supported by the base to fletch the arrow.

In still another embodiment, the method can include sliding a ramp joined with the actuator ring relative to a projection to urge an arm of the plurality of arms toward the central axis where an arrow can be located.

In yet another embodiment, the method can include linearly translating a guide block toward the central axis as the actuator ring rotates. The guide block can engage each arm to urge the arm toward the central axis and to press a respective vane against the arrow.

The current embodiments provide a fletching jig and method for quick, efficient and precise fletching of arrows. With the constrictor ring and its ease of use, a user can quickly and consistently set vanes against an arrow by a simple rotation of the ring. The arms are advanced uniformly and simultaneously to properly place all the vanes about the arrow. The ring also can be rotated to varying degrees to move the arms a small amount or a large amount toward the arrow. In turn, the user can easily control how far the arms are moved toward the central axis and thus the arrow. As a result the jig can effectively be used to fletch arrows of varying diameters with the same set up, without having to swap out parts on the jig to do so. The jig also can automatically adjust to the diameter of the arrow simply by varying the rotation of the actuator ring. The ring further can move all the arms and associated vanes toward the arrow simultaneously due to its engagement with the arms. This can speed up fletching times and allow the user to install more vanes on arrows in shorter periods.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
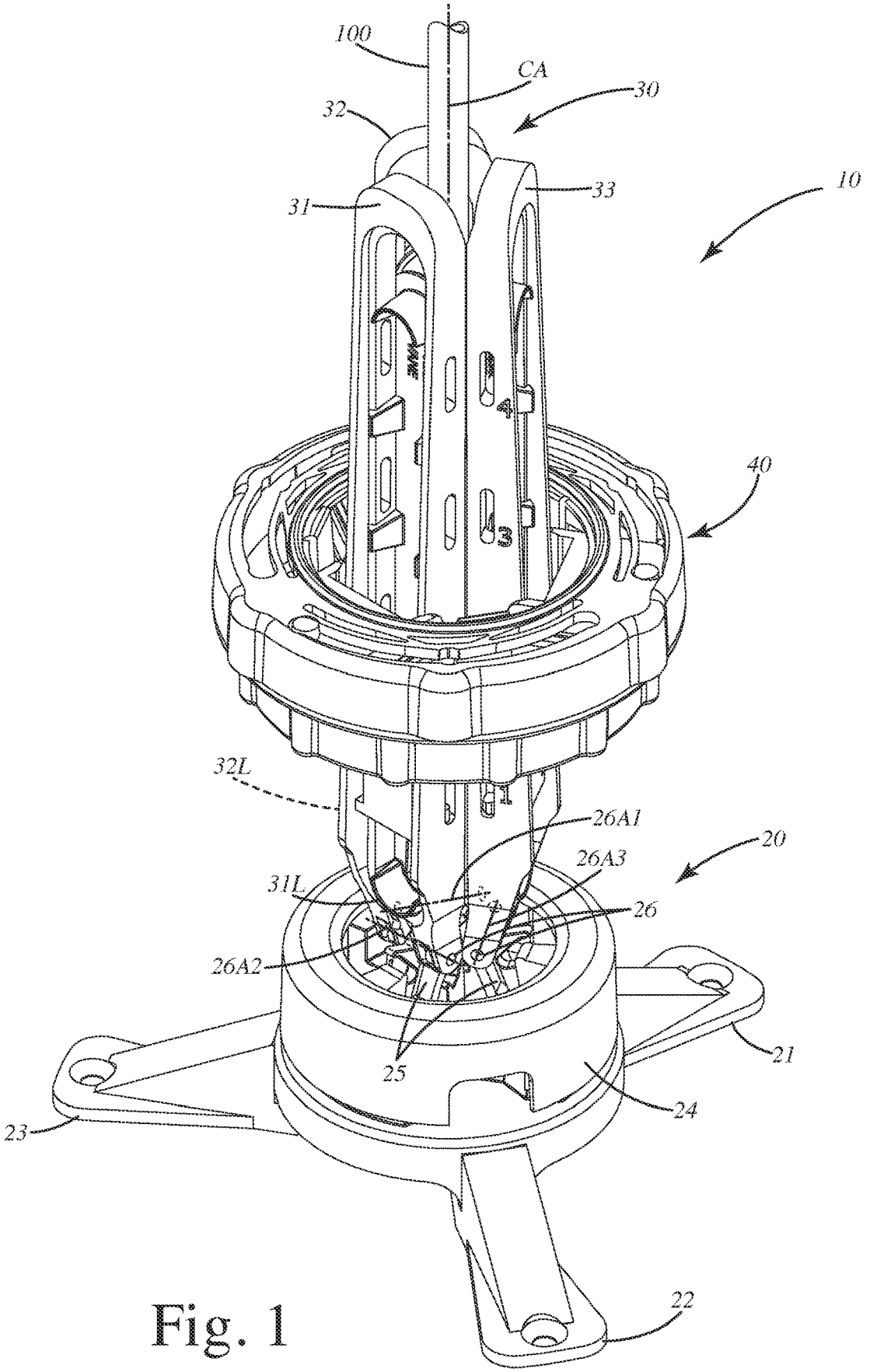
FIG. 1 is a perspective view of a fletching jig of a current embodiment.

A current embodiment of the fletching jig is shown in FIGS. 1-8 and generally designated 10. The fletching jig 10 can generally include a base 20, one or more arms 30, and a constrictor ring 40. The base 20 and jig 10 can define a central axis CA along which an arrow 100 is disposed and generally oriented during a fletching operation as described below. The arrow used in the fletching operation as mentioned above can be a conventional arrow, bolt or other elongated projectile intended to be shot from an archery bow. As used herein, an archery bow can include a compound bow, a recurve bow, a longbow, a crossbow, or other device including limbs or flexible elements that store energy and transfer that energy to a bowstring, cable or other element to propel a projectile.

Figure 2:
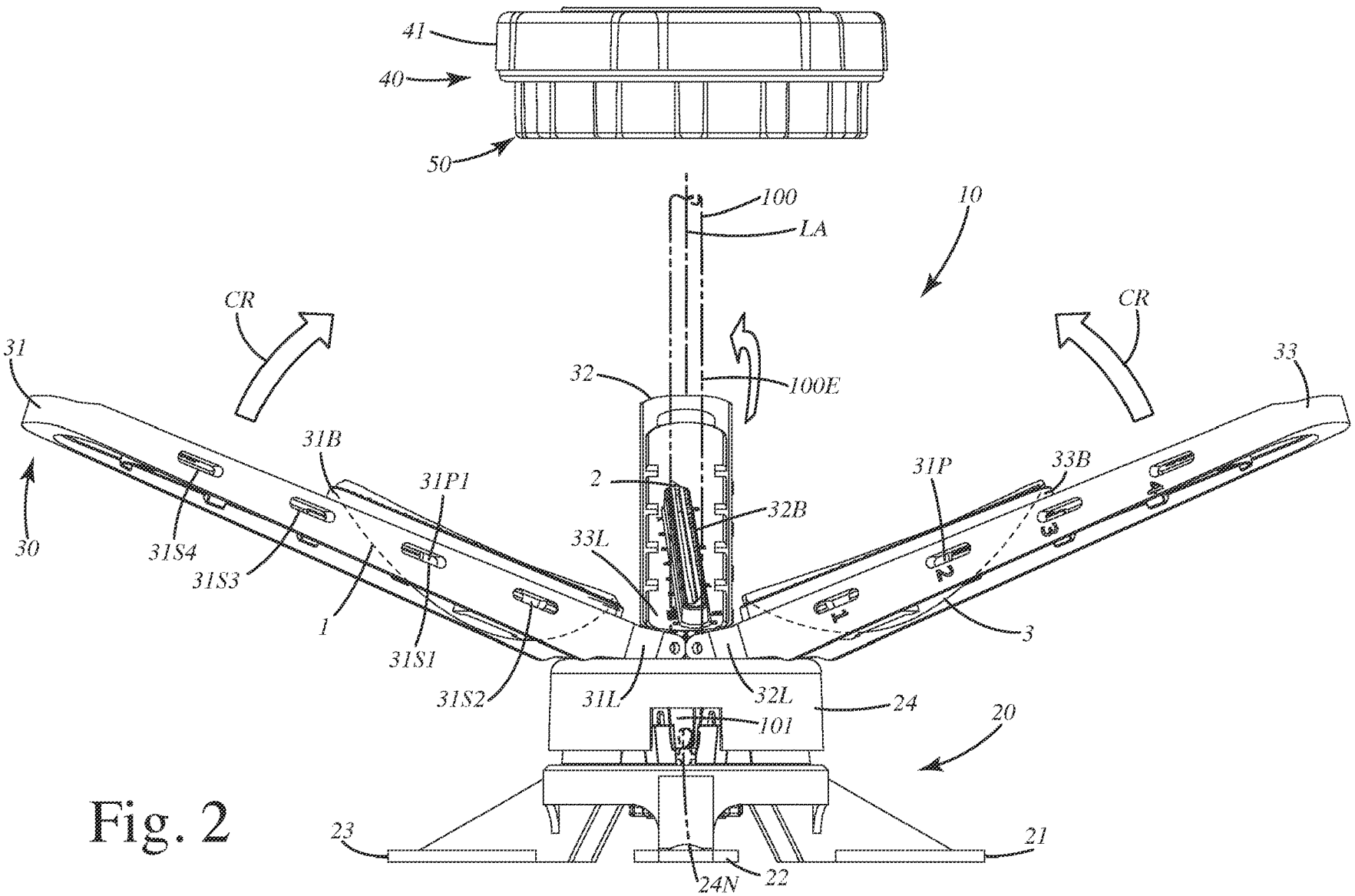
FIG. 2 is a side view of the fletching jig in an open configuration with an arrow shaft initially installed and a constrictor ring before placement around arms of the fletching jig.

Turning to FIGS. 1-2, the various elements will be described, starting with the base 20. The base can include one or more feet 21, 22 and 23. The feet can extend outwardly from a central portion 24 of the base. The feet can include one or more holes such that fasteners can be extended through the feet to secure the base to a work surface, such as a bench or worktable. The central portion 24 can include one or more linkages 25 to which the arms 30 are secured. As shown, there can be three arms, 31, 32 and 33. Of course, in other applications, the fletching jig can be used in conjunction with a different number of arms, for example, one arm, two arms, three arms, four arms, or six arms depending on the number of vanes to be installed on a particular arrow. Also, as used herein, the vanes can refer to any conventional vane, constructed from polymeric, fabric, natural, animal or other material and can interchangeably referred to as fletchings.

With reference to FIGS. 1-2, the linkages 25 can secure to the lower ends 31L, 32L and 33L of the respective arms. For this securement, the arms can be attached to the linkages 25 with one or more pins or axles 26. When secured with the respective axles 26, the arms, and the lower portions thereof, can rotate about respective axes 26A1, 26A2 and 26A3, relative to the linkages and/or the base 20 in general. As illustrated, these axes are oriented about the central axis CA of the base and jig. In general, these axes can intersect one another and can close a polygonal shape, such as a triangle or other shape about the central axis CA. Although not shown, the linkages 25 can be somewhat dynamic such that the axes 26A1, 26A2 and 26A3 can move toward and away from the central axis CA such that the respective lower ends 31L, 32L and 33L of the arms can move in a corresponding manner relative to the central axis CA as well as the arrow 100 when placed along the central axis. Optionally, the base 20 can include a nock element 24N shown in FIG. 2 that can engage a nock 101 associated with the arrow 100 so that the arrow can be secured to the base along the central axis CA in an initial position as shown for example in FIG. 2.

Figure 3:
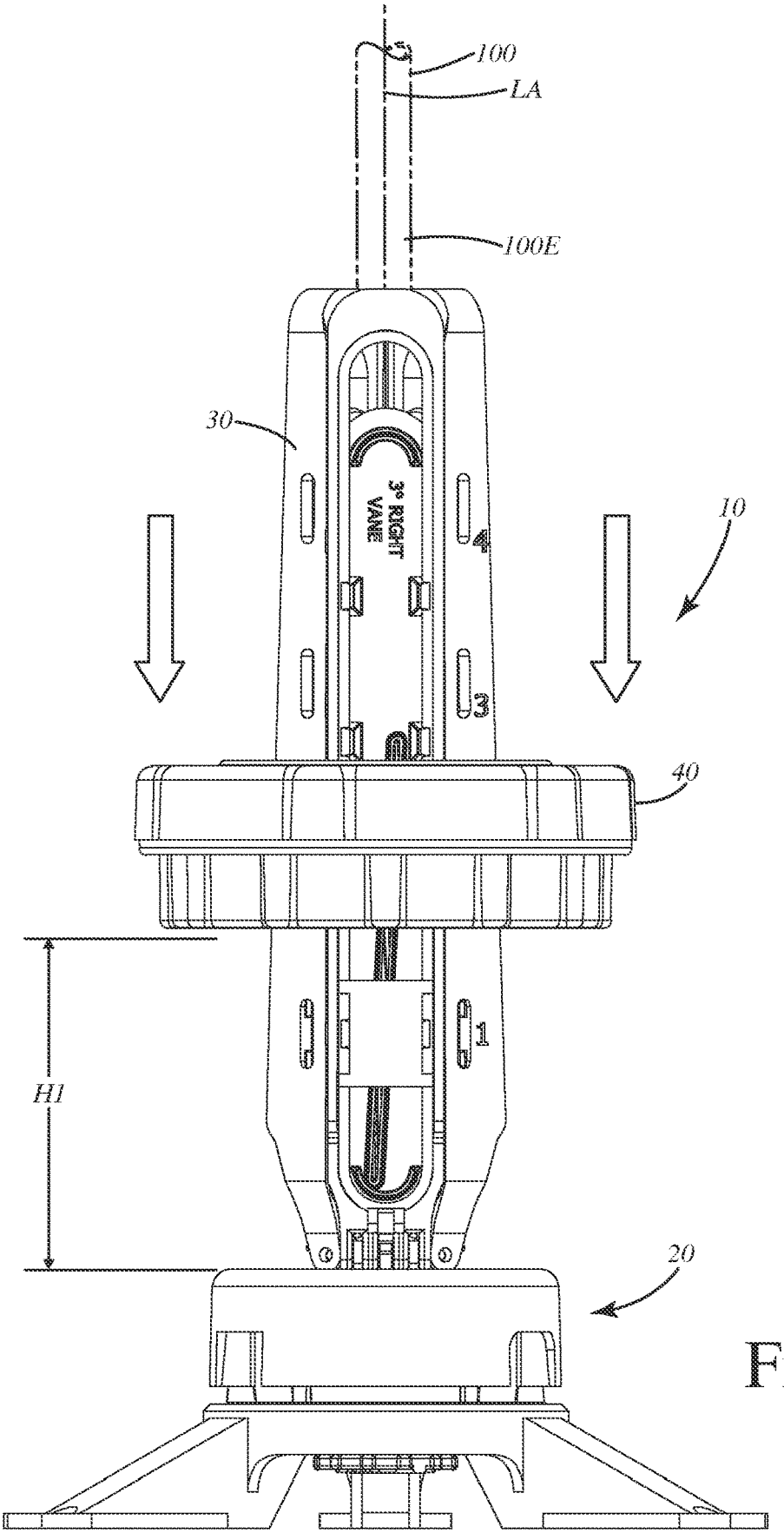
FIG. 3 is a perspective view of the fletching jig with the arms and constrictor ring in operation and holding the arrow in position during placement of vanes on the arrow.

The arms 30, in particular the arms 31, 32 and 33 can be configured to pivot about the lower ends 31L, 32L and 33L from an open mode shown in FIG. 2 to the closed mode shown in FIGS. 1 and 3. To transition from the open mode to the closed mode, the arms can be lifted upward to move and rotate in respective direction CR toward the central axis CA to be placed immediately adjacent the arrow 100. Each of the respective arms 31, 32 and 33 can be configured to receive to support a respective vane 1, 2 and 3. To accommodate a vane, each respective arm can include a respective vane support bracket 31B, 32B and 33B. These vane support brackets can be moveable along the arms so that the supported vane can be placed at a particular location along the arrow 11. Optionally, to make the support brackets moveable and repositionable, the brackets can include pins or fingers 31P1 and 31P2 shown with respect to the arm 31. The other arms and brackets can have similar structures, so will not be described again here. The pins can fit within corresponding apertures 3151 and 3152 to secure the vane bracket 31B in a predetermined location relative to the arm and thus relative to the arrow when the arm is closed to engage the vane against the arrow. The bracket and the pins can be moved to other apertures, for example, 31S3 and/or 31S4 to change the distance from the support bracket 31B relative to the lower end 31L of the arm 31. The bracket can lock with the pins inside the apertures to secure the vane in particular location relative to that lower end 31L. Again, by changing the location of the bracket 31B along the arm, a user can select the distance the vanes are placed from a nock 101 of the arrow 100, which in turn can customize the arrow for a particular flight characteristic.

Optionally, the vane support brackets can be modifiable to support a vane in a particular angular orientation relative to the central axis and the exterior surface 100E of the arrow 100 when the arms are closed, for example, as shown in FIG. 1. In particular, the support brackets optionally can hold the vanes parallel to the central axis of the jig and thus the longitudinal axis of the arrow. In other cases, the support brackets can be configured to support and hold the vane at an offset angle, optionally about 1, 2, 3, 4 or 5 degrees, relative to the central axis and the longitudinal axis of the arrow. In yet other applications, the vane support brackets can have a helical configuration to support a vane in a spiral or helical orientation when placed against an arrow 100 and its exterior 100E. Optionally, the vane support brackets can be absent, with the arms directly supporting the vanes. In such a construction (not shown), the arms can be in the form of elongated plastic defining slots sized to receive the vanes. This configuration, however, may not provide adjustability to move a vane distal from or closer to the nock 101, and/or alter the angled of a vane relative to central axis CA of the jig and/or the corresponding axis of the arrow 100.

Figure 4:
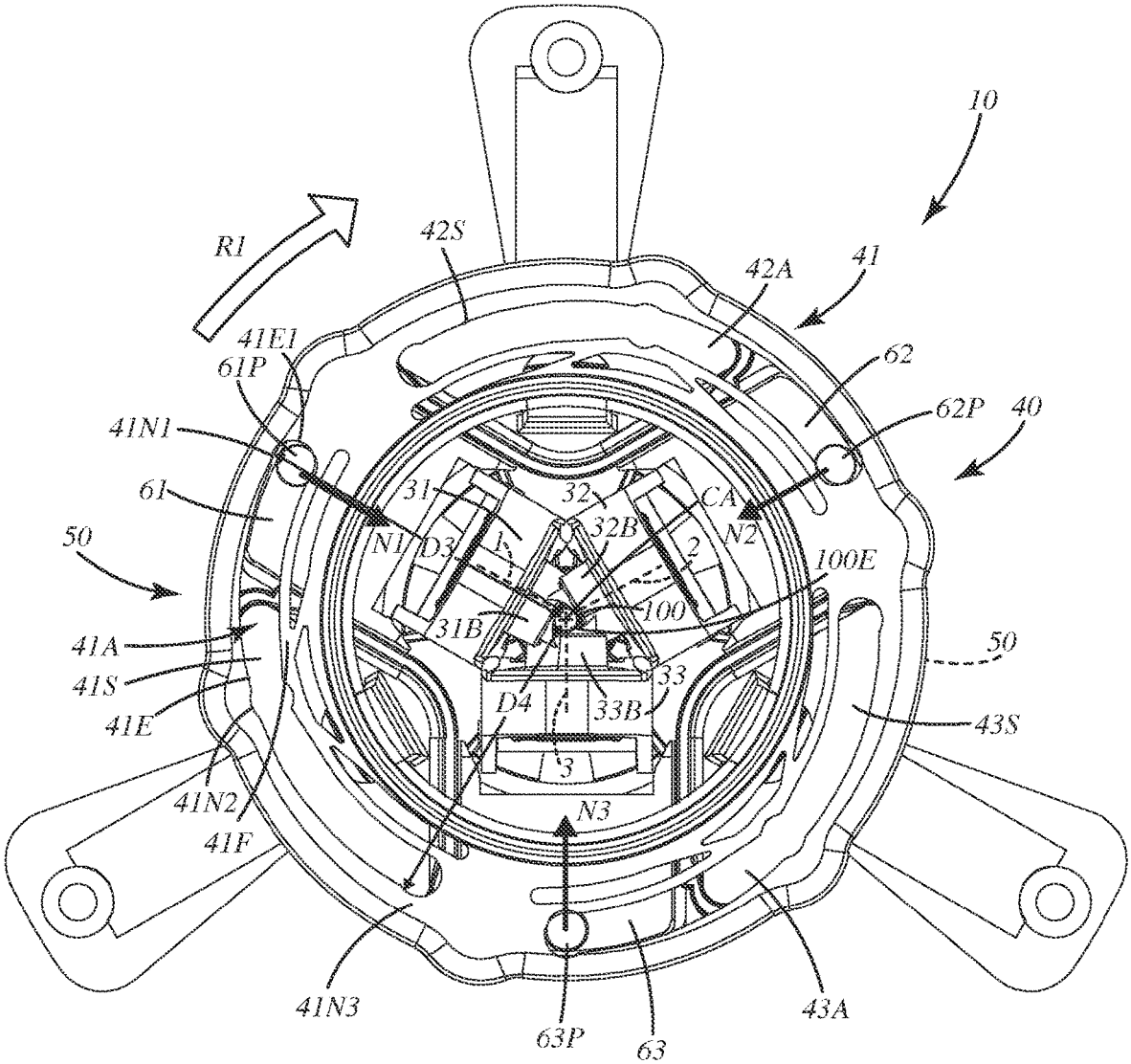
FIG. 4 is a top view of the fletching jig holding the arrow in position during placement of vanes on the arrow.

The fletching jig 10 also can include a ring, referred to as a constrictor ring 40 herein. The constrictor ring 40 can be configured to be moved and slide downward over and surrounding the arms 31, 32 and 33 of the jig 10 when the arms are in the upright configuration as shown in FIGS. 1, 3 and 4. The ring 40 jig can be removed from the arms 30, as shown for example in FIG. 2, where it is disengaged from the arms and set off to the side of the base 20 and arms 30. The constrictor ring 40 can be configured to move longitudinally along the central axis CA toward and away from the base 20, to hold the arms in place when fletching an arrow with vanes. Generally, the constrictor ring 40 can be used to set the arms in position to engage the vanes 1, 2 and 3 against the arrow exterior 100E when the arrow 100 is disposed along the central axis CA of the jig 10.

With reference to FIGS. 1-4, the constrictor ring 20 can include a support portion 50 to which an actuator ring 41 is rotatably mounted. The support portion 50 can include elements that directly engage the arms 30 so as to move the arms toward the arrow 100 and engage the vanes 1, 2 and 3 against the exterior 100E of the arrow 100 when aligned with the central axis CA. The support portion 50 can include one or more guides 51, 52 and 53 which correspond to the respective arms 31, 32 and 33 and move those respective arms. As illustrated, there can be three guides 51, 52 and 53, however the number of guides can vary depending on the number of arms and respective vanes to be joined with an arrow. As shown, the guides can be disposed at 120° angles relative to one another when there are three vanes to be applied to an arrow. In cases where there are to be four vanes to be applied to an arrow, the guides (and arms) can be increased number to four, and can be offset at 90° relative to one another. When fewer vanes are to be applied to an arrow, there may be only two guides and arms offset relative to one another 180°.

Figure 5:
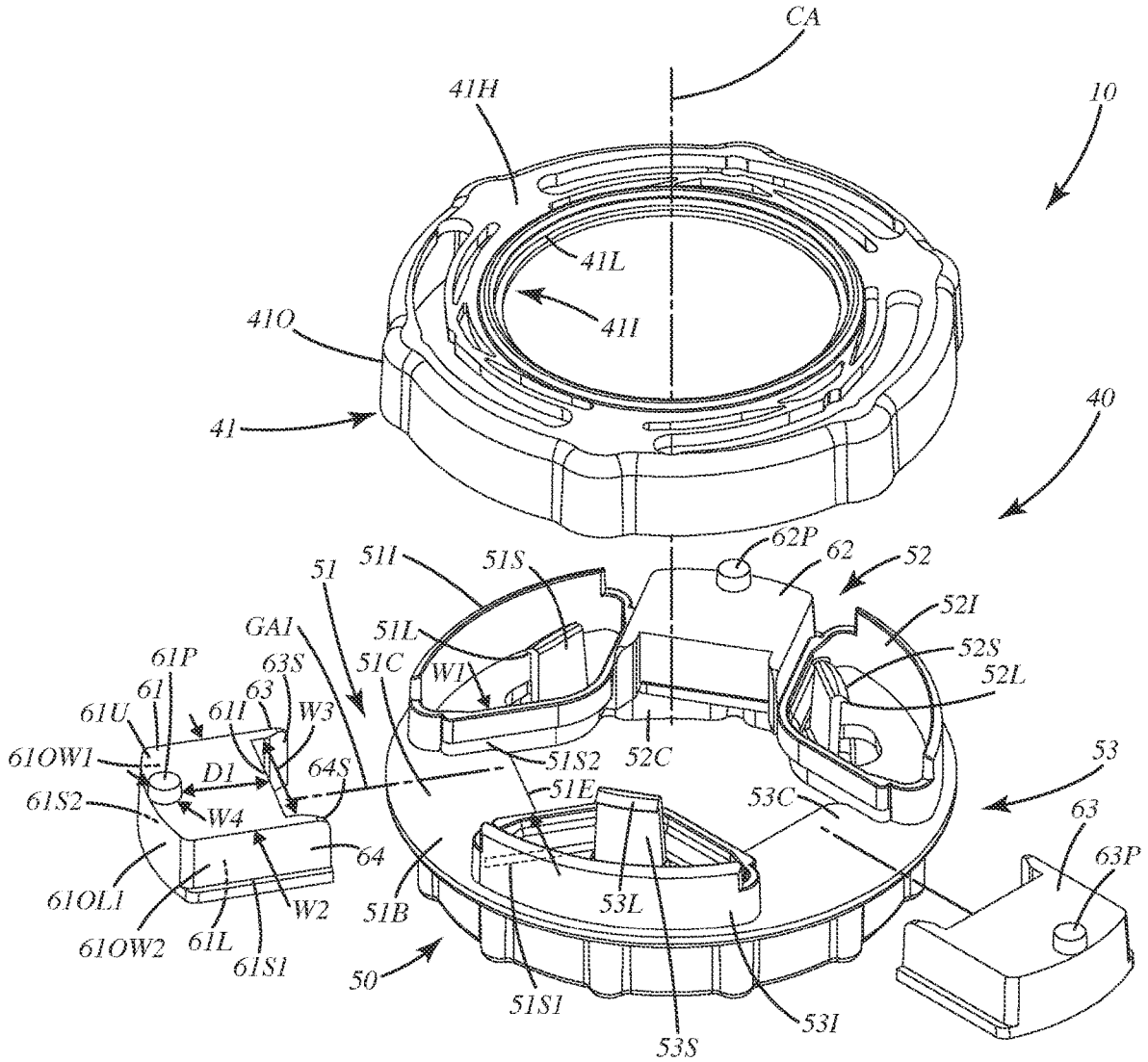
FIG. 5 is an exploded view of the constrictor ring.

With reference to FIGS. 4 and 5, the first guide 51 and first guide block 61 will be described, noting that the other guides 52, 53 and guide blocks 62, 63 can be identical and can operate and interact with the corresponding arms 30 and actuator ring 41 as described below. The first guide 51 can be configured to receive the first guide block 61. This first guide block 61 can be movably disposed within the first guide and aligned with the first arm 31 when the constrictor ring 40 is disposed around the multiple arms 30. In this construction, the first guide 51 can be in the form of a channel 51C. The channel 51C can be of a width W1 that is configured and sized larger than a width W2 of the first guide block 61. The channel 51C can include a bottom wall 51B over which the guide block 61 can move or slide. The channel 51C also can include opposing cutouts or rails 51S1 and 51S2 that can slidably receive projections or shoulders 61S1 and 61S2 on the guide block 61. The positioning of the projections or shoulders in or along the elongated cutouts or rails can assist in precisely and consistently guiding the guide block 61 as it moves along a guide axis GA1 toward the central axis CA. Of course, this configuration can be altered and/or reversed, for example, shoulders or projections can be incorporated into the sidewalls of the guide channel 51C with corresponding slots or recesses in the walls of the guide block 61. Other constructions are contemplated for ensuring that the guide block 61 moves in a level and consistent manner toward and away the central axis CA along a guide axis GA1 that can intersect that central axis CA.

The guide channel 51C can be configured to at least partially receive a portion of the movable arm 31 therein. The channel 51C can terminate at a first forward edge 51E which can be placed near against the arm 31 when the constrictor ring 40 is placed over the arms surrounding them. The first guide block 61 can be configured to move within the guide 51C. The first guide block 61 can include an upper surface 61U and an opposing lower surface 61L between which outer walls 61OW1 and 61OW2 extend. These upper and lower surfaces also can be joined via an outside wall 61OL which can be rounded to fit inside the interior 41I of the actuator ring 41. The guide block 61 can include an inner wall 611 which can be bounded on opposing sides via a first fin 63 and a second fin 64. The first and second fins can include angled or rounded surfaces 63S respectively that can engage the first arm 31 when the guide block 61 moves toward the central axis CA. These surfaces optionally can center the arm 31 in the guide and ensure that the arm enters the guide when installing the ring 40, and that the guide block travels consistently to push the arm 31 toward the central axis. This first fin and second fin can be separated from one another by a third distance W3, which can be less than the overall width W2 of the guide block 61 and less than the width W1 of the channel within which it is disposed.

Each guide block also can include a respective element that interacts with the constrictor ring 41. As shown in FIGS. 4 and 5, these elements can be in the form of projections 61P, 62P and 63P. Given the similarity of these projections among the different first, second and third guide blocks, only the one associated with the first guide block 61P will be described here. The projection 61P can extend from the upper surface 61U of the first guide block 61. The projection 61P can be in the form of a post, pin or other element that projects outward from the body of the guide block. This projection 61P can be disposed a distance D1 from the interior edge 611 which engages the respective first arm 31. This distance can be greater than the overall width W4 of the greatest dimension of the projection 61P. The distance can be selected such that the actuator ring 41 can act on the post and move the first guide block 61 a sufficient distance within the channel or guide 51C to move the first arm 31 toward the central axis CA to engage the vane 1 satisfactorily against the arrow 100.

As shown in FIG. 5, the support portion 50 can include one or more connectors 51S, 52S and 53S that are disposed between the respective channels 51C, 52C and 53C to receive each of the respective guide blocks. These connectors 51S, 52S and 53S can be in the form of elongated projections that extend upward from the respective islands 51I, 52I and 53I separating each of the respective channels and optionally forming the associated guide walls of those channels. Each of the connectors can include an upper lip 51L, 52L and 53L, which can be configured to snap fit over a connector ring or lip 41L associated with the actuator ring 41. The connectors be resilient so that when the lip of a respective connector is guided up and adjacent the lip 41L, it can bend and then snap in place to secure the actuator ring 41 to the support portion 50. Of course, other connectors can be used to join the actuator ring to the support portion, depending on the application. When these elements are connected, the actuator ring 41 can rotate freely relative to the support portion 50. When the constrictor ring 40 is placed on the jig and surrounds the arms, the actuator 41 can rotate freely about the central axis CA. The support portion 50 is positioned so that the arms 30 fit within the respective channels such that the support portion does not rotate about the central axis CA.

The actuator ring 41 will be described with the reference to FIGS. 4 and 5. The ring can include an outer wall 41O and upper surface 41U. As mentioned above the upper surface 41U can be bounded by an inner annular lip 41L. The outer wall 41O and upper surface 41U can bound a ring interior 41I which generally houses the guide blocks 61, 62 and 63 within the channels 51C, 52C and 53C or guides of the support portion 50.

The actuator ring 41 can include a ramp having one or more ramp parts 41A, 42A and 43A. These ramp parts and the ramp in general can be registered with the respective projections 61P, 62P and 63P associated with the respective guide blocks 61, 62 and 63. The ramp and its ramp parts can generally function to move the guide blocks and thus the arms and supported vanes toward the arrow. In particular, rotation of the actuator ring 41 in a direction R1 as shown in FIG. 4 can cause the ramps 41A, 42A and 43A to interact with a projections 61P, 62P and 63P such that those projections are guided in the respective directions N1, N2 and N3 toward the central axis CA. When this occurs, the associated, respective guide blocks 61, 62 and 63 also move in those directions N1, N2 and N3. As a result, the arms 31, 32 and 33 also move in those directions toward the central axis CA. As a result, the vanes 1, 2 and 3 supported by the respective arms also move toward the central axis CA and more particularly toward the arrow 100 and its exterior 100E. Optionally, when the actuator ring 41 rotates in direction R1, the underlying support portion 50 does not rotate relative to the arms or the central axis in any meaningful way.

With further reference to FIGS. 4 and 5, the first ramp part 41A, the second ramp part 42A and the third ramp part 43A, and the ramp in general, can include or be in the form of one or more slots. As shown, the ramp parts can include a first slot 41S, a second slot 42S and a third slot 43S. The slots can be defined within or by the upper surface 41U of the actuator ring 41. Each of the slots can include engagement edges along perimeters thereof, each having a first end and a second and that is optionally rounded or curved. Only the first ramp part 41A and first slot 41S will be described here, with it being understood that the other ramp parts and slots can include similar or identical features to interact with the respective guide blocks to move those guide blocks and an associated arm toward the central axis to fletch the arrow with the vanes supported by the arms.

In particular, the first ramp part 41A can be in the form of the slot 41S which can include a first engagement edge 41E. This first engagement edge 41E can oppose a second engagement edge 41F. The first engagement edge 41E can be located on the exterior of the actuator ring 41 while the second engagement edge can be located closer to the central axis. These edges can extend parallel to one another about the central axis CA and form the inner and outer edges of the slot. The slot also can include a first end 41E1 and opposing second end 41E2. These ends can be spaced in different distances D3 and D4 from the central axis CA. Optionally, the distances D3 and D4 can be taken from the central axis CA to the outer part of the slot, to the engagement edge 41E. The distance D3 can be greater than the distance D4. The second end 41E2 thus can be radially closer to the central axis than the first end 41E1. The respective first engagement edge and second engagement edge also can curve around the central axis CA in an arcuate manner as the edges extend from the first end 41E to the second end 41E2. Generally, the ramp part 41A and ramp in general can curve toward the central axis as the ramp extends at least partially around the central axis.

As mentioned above, the first projection 61P can be registered in the slot 41S. Thus, as the actuator ring 41 is rotated in direction R1, the post 61P and the engagement edges 41E and 41F slide relative to one another. With the first projection 61P being constrained within the slot 41S, and the slot curving generally toward the central axis CA, the rotation and relative movement of the slot relative to the projection causes the projection to move in direction N1 toward the central axis CA. As mentioned above this causes the arm 31 and the vane 1 supported by it to move toward and eventually engage the exterior surface 100E of the arrow 100. Optionally, the first projection 61P engages the ramp part 41A when the actuator ring 41 is rotated, such that the ramp part 41A urges the first guide block 61 into engagement with the first arm 31 to thereby urge the first arm 31 toward the central axis CA while the first vane 1 is supported on the first arm 31.

In some cases, the ramp and the respective ramp parts can include one or more notches to enable the jig 10 to precisely and consistently fletch arrows having different diameters without having to modify the jig or swap out different arms or vane support brackets. The ramp part 41A with exemplary notches will be described in detail here, noting that the other ramp parts 42A and 43A can have similar notches to achieve similar results. The ramp part 41A, in particular the slot 41S, can include a first notch 41N1, a second notch 41N2 and a third notch 41N3. These notches can correspond to movement of the guide block 61 toward the central axis a predetermined amount that corresponds to a diameter of a particular arrow. Optionally, the number of notches can be varied to accommodate settings for a number of different diameter arrows. With the different notches, a user can utilize those notches to set the arms, and thus the vanes, at particular distances from the central axis and properly place the vanes against arrows having shafts of different diameters. This is achieved by the ramp parts moving the respective guide blocks different distances toward the central axis, depending on the notch in which the projections are located.

Figure 6:
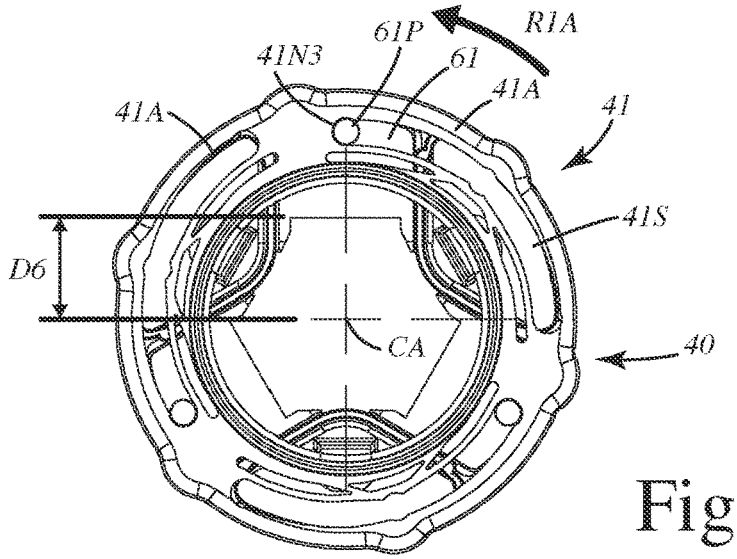
FIG. 6 is a top view of the constrictor ring in a first mode to accommodate a first arrow shaft diameter.

For example, as shown in FIG. 6, the actuator ring 41 can be rotated an amount R1A until the projection 61P is disposed in the notch 41N3. This notch can be associated with a portion of the ramp part 41A that is closest to the central axis CA along the slot 41S. Accordingly, the guide 61 can be displaced a distance D6 from the central axis CA when the projection is in this notch. As a result, the arm and vane associated with it can be placed against the arrow. This distance D6 can be a relatively small distance, compared to the distances D7 and D8 in FIGS. 7 and 8. In particular, the distance D6 can be less than the distance D7, and the distance D7 can be less than the distance D8. As a result, the guide block 61 pushes the associated arm 31, shown in FIG. 4, closer to the central axis CA, than when the projection 61P is in the second 41N2 or third notch 41N3 along the ramp part 41 or slot 41S.

Figure 8:
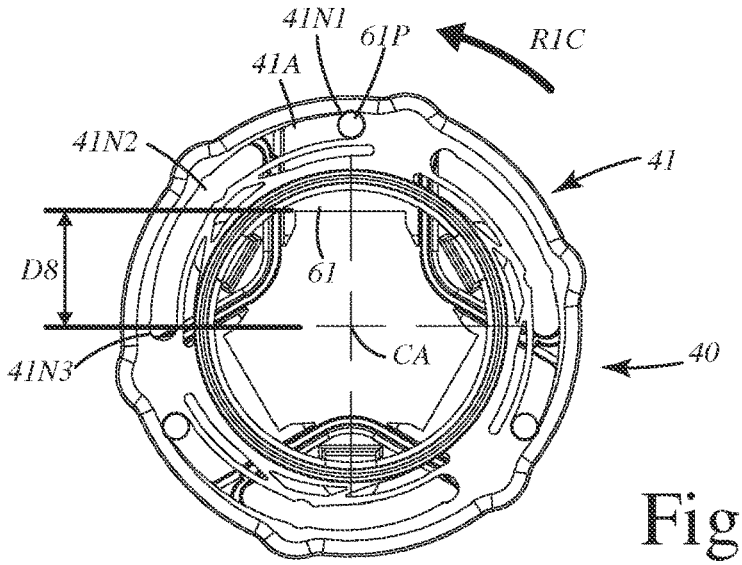
FIG. 8 is a top view of the constrictor ring in a third mode to accommodate a third arrow shaft diameter.

When the actuator ring 41 is rotated an amount R1B to register the projection 61P in the second notch 41N2, the guide block 61 is disposed the distance D7 from the central axis CA. Again, this distance can be less than the distance D8 but greater than the distance D6 as shown in the respective FIGS. 8 and 6. This positioning of the spacer block can accommodate a larger diameter arrow shaft, than when the projection 61P is in the third notch 41N3, yet still can properly place a vane supported by the arm 31 against that arrow. When the actuator ring 41 is rotated an amount R1C, as shown in FIG. 8, such that the projection 61P registers in the first notch 41N1, the guide block 61 is spaced a distance D8 from the central axis, which distance D8 is greater than the other distances D6 and D7 when the projection 61P engages the other notches 41N2 and 41N3. This positioning of the spacer block can accommodate a larger diameter arrow shaft, than when the projection 61P is in the third notch 41N3 or second notch 41N2, yet still can properly place a vane supported by an arm against that arrow shaft. With the different preset distances corresponding to the different notches along the slots or ramp parts, the actuator ring can be selectively rotated a predetermined amount to consistently move an arrow vane a particular preset distance to accommodate a variety of different diameter shaft arrows, and yet still properly secure those vanes in place against the exterior surfaces of those arrows.

As described above, the ramp of the actuator ring 41 can include different ramp parts 41A, 42A and 43A. Optionally, these ramp parts, when in the form of slots, each individually can curve inward toward the central axis CA in different locations. Each slot also can extend partially around the central axis CA. The slots and their engagement edges as shown, however, can be separated from one another. This is so that each of the associated guide blocks can be moved in corresponding amounts toward the central axis CA, with each of the respective arms, thereby engaging a respective vane against the arrow with an equal force. If the ramp parts were all connected and all curved as a single arch around the central axis, the different projections would move the respective guide blocks to engage the respective vanes carried by the respective arms improperly, with some of the vanes being moved too close to the central axis. Further optionally, the curved or rounded engagement edges of the respective ramp parts can be identical through an angular disposition, but also can be separated from one another a distance so that the motion imparted by the ramp parts are different from one to the next.

As mentioned above, the fletching jig 10 is suitable to allow a user to fletch an arrow with one or more vanes. One embodiment of the method generally can include: providing a plurality of arms pivotally joined with a base, each arm supporting a respective vane; placing an arrow along a central axis of the base; moving the plurality of arms toward the central axis and the arrow; and rotating an actuator ring around the central axis to urge the plurality of arms toward the central axis, whereby the respective vanes supported on the respective arms are moved toward the arrow supported by the base to fletch the arrow.

A more particular embodiment of the method can be understood with reference to FIGS. 1-2. Starting with FIG. 2, an arrow 100 can be placed on the central axis of the jig 10. The nock 101 of the arrow can be registered with the base 20. The arms 30 can be in an open mode as shown. Each of the arms and the respective vane support brackets 31B, 32B and 33B can be loaded with a respective vane 1, 2 and 3. The brackets can be placed along the arm using the respective pin registration in the apertures along the sides of the arms, depending on the intended distance of the vane from the nock. With the vanes placed properly on the brackets, an adhesive, glue or other material can be applied to each of the respective vanes so that they can be secured to the arrow when brought into engagement with the exterior surface of the arrow.

The arms 31, 32 and 33 can be closed and move toward the central axis, optionally pivoting about the respective axes 26A1, 26A2 and 26A3. The arms can be placed in an upward orientation as shown in FIG. 3, and the constrictor ring 40 can be placed over the arms 30 and moved downward in direction L1. When this occurs, the inner edges of each of the respective guide blocks engages the respective arms 30. The fins of each of the guide blocks can assist in guiding the constrictor ring downward along the respective arms. The constrictor ring 40 can eventually settle a height H1 one from the base 20. This can be governed by the outer portions of each of the arms engaging the guide blocks. After the constrictor ring 40 is placed, the support portion 50 is generally stabilized and in a fixed position relative to each of the respective arms 30 and the base.

With the support portion 50 being disposed in a stationary orientation relative to the arms, the base, the arrow and the central axis, the user can then actuate the actuator ring 41. The user can do so by rotating actuator ring in direction R1 as shown in FIG. 4. As mentioned above, when the actuator ring 41 is rotated, the ramp, and in particular the ramp parts 41A, 42A and 43A can move relative to the respective projections 61P, 62P and 63P. As this occurs, the engagement edges of each of the ramp parts engage the respective projections. The ramp and in particular, the ramp parts each slide relative to the respective projections to urge the respective arms toward the central axis CA. More particularly, the projections move within the slots and are urged toward the central axis CA in directions N1, N2 and N3. As this occurs, the associated guide blocks 61, 62 and 63 move within the guides 51, 52 and 53. Each of the guide blocks can be linearly translated toward the central axis CA as the actuator ring 41 rotates. This in turn presses those guide blocks against the respective arms 31, 32 and 33 so that the vanes 1, 2 and 3 associated with those arms, press against the exterior of the arrow so that the adhesive can secure those vanes to that exterior.

Figure 7:
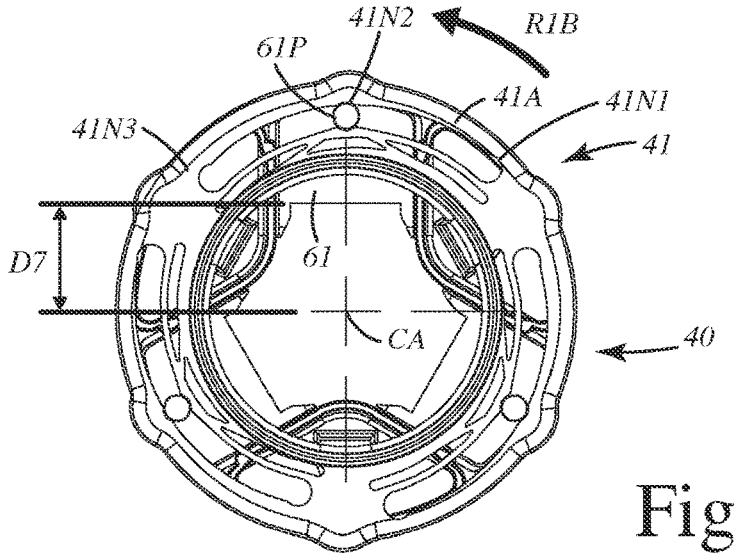
FIG. 7 is a is a top view of the constrictor ring in a second mode to accommodate a second arrow shaft diameter.

Depending on the precise diameter of the arrow, the user can rotate the actuator ring 41 in the direction R1 a predetermined amount. As the rotation continues, the projections are pushed within the ramp parts closer and closer toward the central axis. As mentioned above, the ramp parts can include particular notches at the respective ends or anywhere between those ends. Those notches can correspond to preselected diameters of arrows to provide precise placement of the vanes on the arms so that they can be joined to the arrow in a parallel alignment. Depending on the application, the user can rotate the actuator ring 41 predetermined amounts R1A, R1B or R1C as shown in FIGS. 6-8. Those notches can secure the project respective projections and lock them along the outer engagement edges of the ramp parts so that the constrictor ring can hold the arms and thus the associated vanes in a fixed position and with a fixed force against the arrow for predetermined amount of time dictated by the adhesive, the vanes or other factors.

After the adhesive cures and the vanes are secured to the arrow 100, the constrictor ring 40 can be rotated in an opposite direction from R1 as noted above. This can retract the guide blocks away from the central axis and arrow, and the arms also can move away from the same. The constrictor ring 40 can be lifted up and off the arms, and removed from the jig. The arms 30 can be opened to allow release of the arrow, now fletched with the vanes 1, 2 and 3, from the jig 10. This process can be repeated multiple times with multiple arrows.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. A fletching jig comprising:

a base defining a central axis;

a first arm moveably joined with the base, the first arm configured to support a first vane;

a second arm moveably joined with the base distal from the first arm, the second arm configured to support a second vane;

a third arm moveably joined with the base distal from the second arm, the third arm configured to support a third vane, the third arm, the first arm and second arm being selectively moveable toward and away from the central axis when an arrow is aligned with the central axis;

a ring disposed outwardly from the first arm, second arm and third arm, the ring being moveable longitudinally along the central axis toward and away from the base, the ring comprising:

a support portion including a first guide within which a first guide block is moveably disposed and aligned with the first arm, a second guide within which a second guide block is moveably disposed and aligned with the second arm, and a third guide within which a third guide block is moveably disposed and aligned with the third arm, the support portion secured against rotation with respect to the first arm, the second arm and the third arm;

an actuator ring rotatably mounted to the support portion and configured to be selectively rotated about the central axis, the actuator ring including a ramp that interfaces with the first guide block, the second guide block and the third guide block to urge the first arm, second arm and third arm toward the central axis when the actuator ring is rotated about the central axis, whereby when the actuator ring is rotated a first vane supported on the first arm is moved toward an arrow supported above the base, a second vane supported on the second arm is moved toward the arrow, and a third vane supported on the third arm is moved toward the arrow.

2. The fletching jig of claim 1, wherein the first guide block includes a first projection that engages the ramp when the actuator ring is rotated such that the ramp urges the first guide block into engagement with the first arm to thereby urge the first arm toward the central axis while the first vane is supported on the first arm.

3. The fletching jig of claim 2,
wherein the first projection is a first post,
wherein ramp includes a first engagement edge along a first slot having a first end and a second end, the second end being radially closer to the central axis than the first end,
wherein the first post is slideably registered in the first slot.

4. The fletching jig of claim 2,
wherein the second guide block includes a second projection that engages the ramp when the actuator ring is rotated such that the ramp urges the second guide block into engagement with the second arm to thereby urge the second arm toward the central axis while the second vane is supported on the second arm,
wherein the third guide block includes a third projection that engages the ramp when the actuator ring is rotated such that the ramp urges the third guide block into engagement with the third arm to thereby urge the third arm toward the central axis while the third vane is supported on the third arm.

5. The fletching jig of claim 4,
wherein the second projection is a second post,
wherein ramp includes a second engagement edge along a second slot distal from the first slot, the second slot having a first end and a second end, the second end of the second slot being radially closer to the central axis than the first end,
wherein the second post is slideably registered in the second slot,
wherein the third projection is a third post,
wherein ramp includes a third engagement edge along a third slot distal from the first slot and the second slot, the third slot having a first end and a second end, the second end of the third slot being radially closer to the central axis than the first end,
wherein the third post is slideably registered in the third slot.

6. The fletching jig of claim 1,
wherein the ramp includes a first engagement edge slidably interfaced with the first guide block,
wherein the ramp curves toward the central axis as the ramp extends around the central axis.

7. The fletching jig of claim 6,
wherein the first guide block includes a first post that slides relative to the first engagement edge and toward the central axis as the actuator ring is rotated.

8. The fletching jig of claim 1,
wherein the first guide is a first channel having a first channel axis that extends toward the central axis,
wherein the first guide block moves along a linear path aligned with the first channel axis as the ramp engages the first guide block.

9. The fletching jig of claim 8,
wherein the first guide block includes a first post that projects away from the first guide,
wherein the ramp includes a first slot,
wherein the first post is registered in the first slot.

10. The fletching jig of claim 1,
wherein the ramp includes first, second and third ramp parts, each curving closer to the central axis from a first end to a second end,
wherein each of the first, second and third guide blocks engage respective ones of the first, second and third ramp parts to move each of the respective first, second and third arms toward the central axis.

11. A fletching jig comprising:
a base including a central axis;
a plurality of arms extending away from the base, each arm configured to move toward the central axis and to support a vane;
an actuator ring disposed around the plurality of arms, the actuator ring being selectively rotatable around the central axis to thereby urge the plurality of arms toward the central axis when the actuator ring is rotated about the central axis; and
a support ring engaging the plurality of arms such that the support ring is nonrotatable relative to the plurality of arms,
whereby the vane supported on the respective arm is moved toward an arrow supported above the base when the actuator ring is rotated.

12. The fletching jig of claim 11 comprising:
a plurality of guide blocks;
a support portion that is disposed around the plurality of arms, the support portion including a plurality of guide channels within which respective guide blocks are moveably disposed,
wherein the support portion remains stationary relative to the plurality of arms when the actuator ring rotates about the central axis.

13. The fletching jig of claim 12,
wherein the actuator ring includes a ramp that engages at least one of the plurality of guide blocks,
wherein the ramp is formed via an engagement edge of a slot defined by the actuator ring,
wherein the slot curves inward toward the central axis as the slot extends partially around the central axis.

14. The fletching jig of claim 11,
wherein the actuator ring includes a ramp,
wherein the ramp includes an engagement edge that curves inward toward the central axis as the engagement edge extends partially around the central axis.

15. The fletching jig of claim 11 comprising:
a plurality of guide blocks adjacent the actuator ring,
wherein the actuator ring includes a ramp,
wherein the ramp includes a first ramp part configured to engage a first guide block of the plurality of guide blocks,
wherein the ramp includes a second ramp part configured to engage a second guide block of the plurality of guide blocks,
wherein the first ramp part and the second ramp part each curve radially inward toward the central axis, but at locations about the central axis distal from one another.

16. The fletching jig of claim 15 comprising:
a first projection extending from the first guide block,
a second projection extending from the second guide block,
wherein the first ramp part slidably engages the first projection when the actuator ring rotates,
wherein the second ramp part slidably engages the second projection when the actuator ring rotates.

17. The fletching jig of claim 11 comprising:
wherein the actuator ring includes a ramp,
wherein the ramp includes a plurality of slots disposed around the central axis,
wherein the plurality of slots rotate around the central axis when the actuator ring rotates, with the support ring remaining rotationally stationary relative to the central axis.

18. A method of fletching an arrow comprising:
providing a plurality of arms pivotally joined with a base, each arm supporting a respective vane;

placing an arrow along a central axis of the base;

moving the plurality of arms toward the central axis and the arrow; and rotating an actuator ring around the central axis to urge the plurality of arms toward the central axis, while a support ring adjacent the actuator ring engages the plurality of arms to prevent rotation of the support ring relative to the plurality of arms, whereby the respective vanes supported on the respective arms are moved toward the arrow supported by the base to fletch the arrow.

19. The method of claim 18 comprising:

linearly translating a guide block toward the central axis as the actuator ring rotates, wherein the guide block engages an arm of the plurality of arms to urge the arm toward the central axis and to press a respective vane against the arrow.

* * * * *